United States Patent [19]

Devitt

[11] 4,432,273

[45] Feb. 21, 1984

[54] FAN POWERED ROOF VENTING METHOD AND APPARATUS

[75] Inventor: Gerald J. Devitt, Port Jefferson Station, N.Y.

[73] Assignee: Revere Products Corporation, Solon, Ohio

[21] Appl. No.: 327,807

[22] Filed: Dec. 7, 1981

[51] Int. Cl.[3] ..... F24F 7/02

[52] U.S. Cl. ..... 98/43 C; 98/29; 98/43 A

[58] Field of Search ..... 98/29, 43 R, 43 A, 43 C, 98/116, 119; 236/49

[56] References Cited

U.S. PATENT DOCUMENTS

| | | | |
|---|---|---|---|
| 1,931,066 | 10/1933 | Eckert | 98/31 |
| 2,684,621 | 7/1954 | Cook | 98/116 X |
| 2,833,229 | 5/1958 | Donegan | 98/29 X |
| 3,412,670 | 11/1968 | Jenn et al. | 98/116 X |
| 3,934,494 | 1/1976 | Butler | 98/43 C |
| 4,051,769 | 10/1977 | Nickerson et al. | 98/43 R |

FOREIGN PATENT DOCUMENTS

| | | | |
|---|---|---|---|
| 54-13651 | 2/1979 | Japan | 98/32 |

*Primary Examiner*—Albert J. Makay
*Assistant Examiner*—Harold Joyce
*Attorney, Agent, or Firm*—Prutzman, Kalb, Chilton & Alix

[57] ABSTRACT

A roof vent for flat built-up roofs, having a truncated pyramid-shaped air stack with a protective cap and an internal fan for inducing upward air flow through a check valve at the upper end of the stack. A solar panel provides power for operating the fan, a thermal switch is employed for enabling the fan above an ambient temperature of 50° F. (10° C.) and a humidistat may be employed for disabling the fan below 50% relative humidity.

7 Claims, 1 Drawing Figure

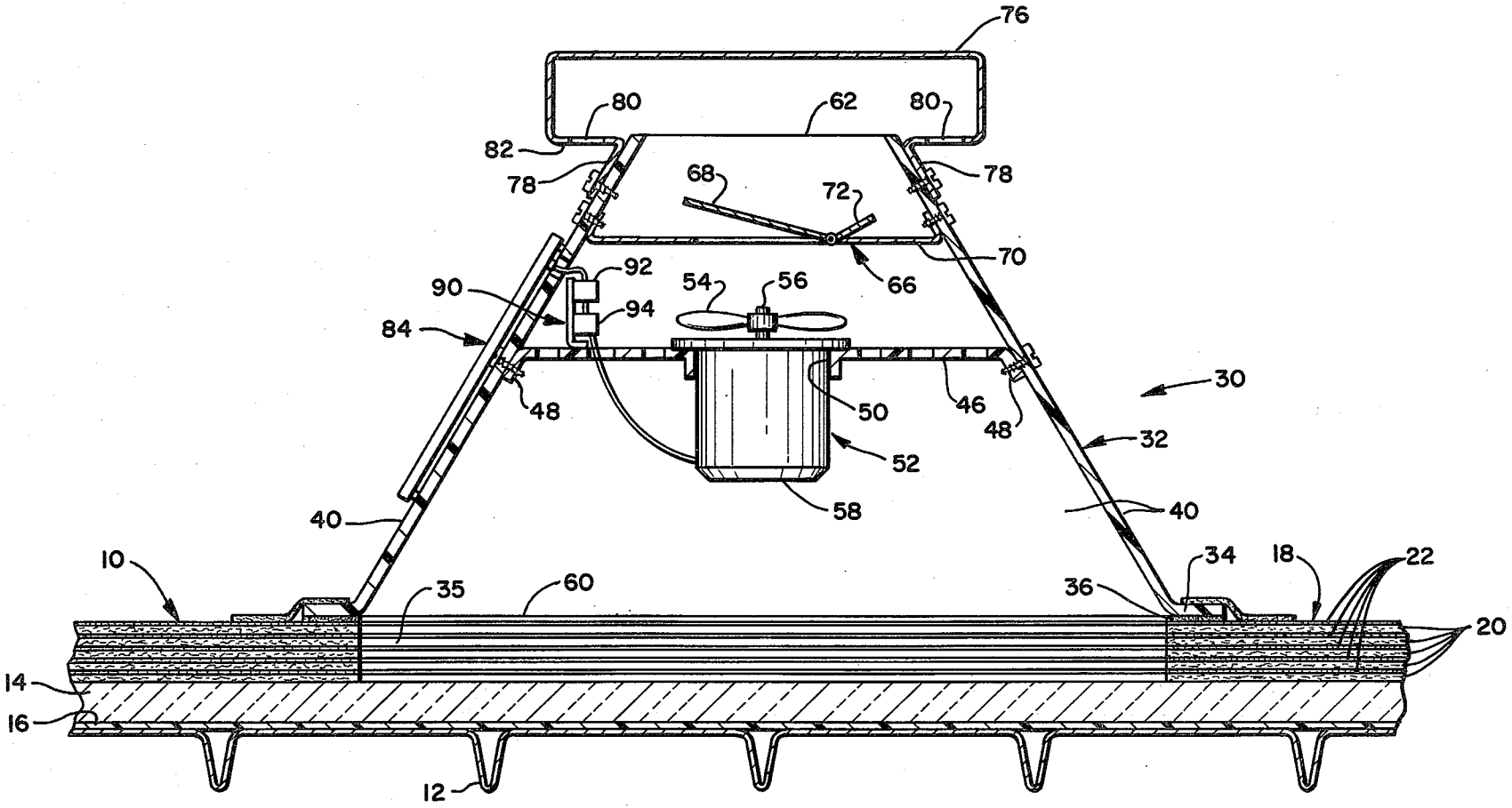
20
22
18
30
34
40
32
36
76
78
70
48
46
80
66
52
62
72
50
58
56
68
54
92
94
80
60
82
78
48
90
84
35
12
40
10
14
16

FAN POWERED ROOF VENTING METHOD AND APPARATUS

DESCRIPTION

1. Technical Field

The present invention relates generally to roof vents for venting flat built-up roofs of the type normally comprising an underlying deck of steel, wood or other structural material, an insulation layer and a semi-rigid roof mat or cover of multilayer sandwich construction usually consisting of two to five felt plies and overlying layers of bitumen.

2. Background Art

In prior art roof vents of the type to which the present invention is directed, passive venting is employed for venting trapped moisture from within a built-up roof as the moisture vaporizes. Also, some prior art roof vents have employed a passive pumping system which aids in removing roof moisture by inducing increased air flow through the vent with a pumping action provided by successive thermal expansion and contraction of air in a discharge plenum of the roof vent.

DISCLOSURE OF INVENTION

In accordance with the present invention, a new and improved roof venting method and apparatus are provided which employ a powered fan for removing moisture from a flat built-up roof before normal moisture vaporization and resultant roof damage can occur.

It is a principal aim of the present invention to provide a new and improved roof venting method and apparatus for removing moisture trapped within a built-up roof well before the moisture has accumulated sufficiently to cause roof blistering or splitting.

It is another aim of the present invention to provide a new and improved roof venting method and apparatus which maintains a built-up roof free of internal moisture without undesirable removal of heat from the internal building space.

It is still a further aim of the present invention to provide a new and improved roof vent which is solar powered and which is both economical in design and reliable in use.

Other objects will be in part obvious and in part pointed out more in detail hereinafter.

A better understanding of the invention will be obtained from the following detailed description and the accompanying drawing of an illustrative application of the invention.

BRIEF DESCRIPTION OF DRAWING

The drawing is an elevation section view, partly broken away and partly in section, of a roof vent installation employing an embodiment of the roof venting method and apparatus of the present invention.

BEST MODE FOR CARRYING OUT THE INVENTION

Referring now to the drawing in detail, a roof vent installation incorporating an embodiment of the present invention is shown employed with a conventional built-up roof 10 having an underlying structural support deck 12 of rigid steel sections fastened to the structural steel (not shown) of the building, for example by spot welding. The steel deck 12 is an exemplary type of structural roof support, and as is well known, wood, precast concrete or poured gypsum or concrete is also used as an underlying structural support deck. A suitable insulation layer 14 is provided on the support deck and if desired, a vapor barrier 16 may be placed between the support deck 12 and insulation 14. Insulation is used on most roofs and typically can be rigid or soft fiberglass, rigid urethane, glass beaded board, asphalt impregnated and coated vegetable board or mineral fiber board or the like. A one-half inch to three inch thick insulation layer is typically provided to adequately retard the heat flow through the roof. The insulation layer may result in the roof surface temperature, in comparision with the surface temperature of an uninsulated roof, being as much as 40° F. (22° C.) hotter in the summer and 10° F. (6° C.) colder in the winter. A vapor barrier 16 is typically used on any roof having an average January temperature below 45° F. (7° C.). A vapor barrier is particularly important in buildings with high humidity since its major purpose is to keep moisture vapor from penetrating or entering the built-up roof structure from the building space below the roof. The vapor barrier 16 is usually a vinyl or plastic sheet which is fastened to the underlying structural deck with its own cement.

A multiple-layer roof mat or cover 18 is applied over the thermal insulation layer 14 to provide a semi-rigid roof covering. The roof mat 18 typically consists of between two to five plies 20 of felt and overlying layers 22 of either an asphalt or coal-tar bitumen which are alternately applied to form a multi-deck sandwich structure. Most often used in built-up roofs is a 15 pound asphalt saturated felt. Such a felt is manufactured primarily from wood or paper fiber and is not waterproof even when saturated with asphalt. Also, such organic felts "wick" or transmit moisture horizontally within each felt ply.

A roof vent 30 incorporating the present invention has a housing with an upright air stack 32 having a lower flat peripheral flange or base 34 for supporting the roof vent 30 on top of the built-up roof 10 after the built-up roof 10 is constructed. A square cut-out or opening 35 (which is preferably the same size as the square inlet opening 60 of the air stack 32) is provided in the roof mat or cover 18 to provide access to all the plies 20 of felt in the roof mat 18. A suitable seal 36 of neoprene cement is applied between the housing flange 34 and the built-up roof mat or cover 18 and a layer of bitumen impregnated fiberglass is applied over the flange 34 to prevent moisture penetration into the built-up roof from above.

The air stack 32 has a truncated pyramid-shape with four sidewalls 40 having, for example the same dimensions and such that the stack 32 has the same symmetrical appearance and configuration from all four sides. The vent stack 32, for example has a height of nine inches, a width of fifteen inches at the base of each sidewall and a width of five inches at the top of each sidewall. The base flange 34 extends laterally outwardly, for example about one inch, sufficiently to prevent the entrance of moisture into the built-up roof from above. The vent housing, including its sidewalls 40 and base flange 34 are, for example made of plastic and such that the entire vent stack and base flange can be molded as a single piece.

A horizontal support plate 46 having depending side flanges 48 secured to the sidewalls 40 of the vent housing stack 32 has a large central opening 50 for supporting an upright electric fan or blower 52 centrally within the vent stack chimney. A suitable fan blade 54 is mounted on an upper end of a vertical drive shaft 56 of an electric fan motor 58 for propelling air, including any entrained moisture and moisture vapor, upwardly from the lower relatively large square inlet opening 60 of the vent stack 32 to its upper square outlet opening 62. The fan support plate 46 is provided with adequate openings to provide for the free flow of air upwardly through the vent stack chimney.

A flapper check valve 66 [or in the alternative a temperature responsive check valve (not shown)] is mounted within the vent stack chimney above the fan unit. The one-way check valve 66 thereby provides for the free flow of air upwardly from the fan unit to the stack outlet opening 62. Reverse or downward air flow in the stack chimney is prevented by the flapper valve 68 and its support plate 70 when the fan motor 52 is de-energized and which might otherwise occur, for example as a result of thermal contraction of the air within the vent stack due to nighttime cooling. The upper end of the vent stack 32 is therefore closed when the flapper valve 68 is closed. The flapper valve 68 is preferably partly counterbalanced, for example by the provision of a rear upturned lip 72.

A generally box shaped cover or cap 76 of the vent housing, made for example of sheet aluminum, is mounted on top of the vent stack 32 to prevent the entry of rain or other foreign matter into the vent stack chimney. The housing cap 76 has a lower depending flange 78 for supporting the cap 76 on the four inclined sidewalls 40 of the vent housing and which is preferably fastened to the sidewalls, for example by suitable conventional sheet metal fasteners, to permit easy removal of the cap 76 for access to the interior of the vent stack. Likewise, the flapper valve plate 70 is preferably secured to the housing sidewalls by suitable sheet metal fasteners to permit removal of the flapper valve plate for access to and removal of the electric fan 52.

A plurality of exhaust or outlet openings 80 are provided around the periphery of a lower plate 82 of the housing cap to exhaust the air flow conducted upwardly through the vent stack chimney. However, the top and four sidewalls of the housing cap 76 are imperforate to prevent the entry of moisture and other foreign matter into the vent housing chimney.

A suitable photovoltaic solar cell or collector 84 is mounted on the exterior of one of the inclined sidewalls 40 of the vent stack 32. The solar collector 84, for example is made of selenium, provides a 0.45 volt output at 550 milliamps and is connected for directly operating the fan motor 52. Consequently, the fan motor 52 is suitably designed to operate efficiently on the low power output of the solar collector 84. The inclination of the sidewalls 40 of the vent stack 32 is preferably established to provide an optimum average collector effectiveness and therefore at an angle approximately equal to the latitude of the vent installation. For example, the inclination is established at 45° for installations between 40° and 50° latitude. Also the roof vent is installed so that its solar collector 84 faces approximately due south.

A fan motor control system 90 is provided in the vent housing for automatically enabling and disabling the fan motor 52. For that purpose, a thermal switch 92 is employed for enabling the fan motor to be energized by the solar collector when the ambient temperature is above 50° F. (10° C.) and for disabling the fan motor when the ambient temperature is below that lower operating limit temperature. When the fan motor 52 is energized, the fan 54 provides for withdrawing air from the built-up roof at the rate of approximately four cubic feet per minute. The fan thereby normally provides sufficient air flow for removing any moisture within the built-up roof 10 well before the moisture would otherwise vaporize and cause the roof to blister or split and therefore before serious moisture caused damage can result. The fan motor 52 remains disabled below the established 50° F. lower temperature limit and such that only relatively low volume passive venting is provided by the roof vent 30 below that temperature. In that regard, the lower operating limit temperature is selected to ensure that the fan motor 52 is enabled for withdrawing moisture well before the roof temperature reaches a sufficiently high temperature [approximately 145° F. (63° C.)] for the rate of moisture vaporization to be sufficient to cause roof blistering or splitting. Also, the lower operating limit temperature is selected to prevent undue heat loss from the interior space of the building due to the relatively high rate of air flow through the vent when the vent motor 52 is energized. In that regard, when the fan motor 52 is energized to increase the volumetric flow rate to approximately four cubic feet per minute, the air is primarily withdrawn from the interior of the building through the underlying roof deck structure, the vapor barrier, if any, and the built-up roof insulation. Also, below the lower operating temperature limit of 50° F. (10° C.), condensation within the upper roof cover 18 may be caused by withdrawing relatively warm air from the interior of the building into contact with the upper cover above the roof insulation and such that moisture would be added to rather than removed from the built-up roof if the fan motor is energized at a low ambient temperature. The 50° F. (10° C.) lower operating limit is selected as an approximate optimum temperature within an approximate 45° F. to 55° F. (7° to 13° C.) temperature range to prevent the accumulation of excessive moisture vaporization on the one hand and undue heat loss from the interior building space on the other.

Also, a moisture sensor or humidistat 94 could be employed in addition to the thermal sensor to provide for enabling the fan motor 52 only when the relative humidity within the air vent housing is above a predetermined level of for example 50%. Thus, where both temperature and humidity sensors are employed the humidistat would provide for maintaining the fan motor disabled even about 50° F. when the relative humidity is below 50%.

It is expected that a powered roof vent 30 of the type described can provide for covering a roof area of approximately 1,000 square feet (i.e. an area within a radius of approximately 18 feet) and that a large built-up roof can be properly vented by placing the roof vents 30 approximately thirty-six feet apart.

As will be apparent to persons skilled in the art, various modifications, adaptations and variations of the foregoing specific disclosure can be made without departing from the teachings of the present invention.

I claim:

1. A flat roof dryer for removing moisture from an insulation cavity formed in a built-up flat roof having a layer of insulation underlying a roof mat having a plurality of plies of roof felt, comprising:

a housing having a lower, flat peripheral base flange adapted for sealingly mounting the housing to the surface of the built-up roof;

a cover means covering the top of said housing to prevent the entry of rain and other foreign matter into the housing;

at least one outlet opening disposed generally below said cover means;

a fan means mounted in said housing to produce a generally upward airflow through said housing;

a one-way flow valve means mounted in the housing and interposed between the cover means and the fan means to permit airflow only in a generally upward direction from said fan means;

an energizing means to automatically energize said fan means; and a control means to prevent energizing of the fan means when the temperature in the housing is below a predetermined temperature.

2. The flat roof dryer of claim 1 wherein the housing has a generally truncated pyramid shape.

3. The flat roof dryer of claim 1 wherein the cover means is a cap member having an upper portion covering the top of said housing and a lower peripheral portion of said cap member defines an outlet opening.

4. The flat roof dryer of claim 1 wherein the one-way flow valve means comprises a counterbalanced flapper valve pivotally mounted relative to an opening generally vertically spaced from said fan means.

5. The flat roof dryer of claim 1 wherein said energizing means further comprises a photovoltaic cell externally mounted to the housing and connected via said control means to said fan means.

6. A built-up flat roof drying system comprising:

a built-up flat roof including a layer of insulation underlying a roof mat having a plurality of plies of roof felt, said roof mat having a cut-out opening defining an insulation cavity;

a housing having a lower flat peripheral base flange sealingly engaging the upper surface of said roof mat, said housing being generally positioned to cover said cavity;

a fan means mounted in said housing to produce a generally upward airflow from said cavity;

a cap member having an upper portion covering the top of said housing and having a lower peripheral portion defining an outlet opening;

a one-way flow valve means mounted in the housing and interposed between the cap member and fan means to permit airflow only in a generally upward direction from said cavity;

energizing means to automatically energize said fan means; and control means to prevent energizing of the fan means when the temperature in the housing is below a predetermined temperature.

7. The dryer system of claim 6 wherein the housing has a generally truncated pyramid shape.

* * * * *